AU 118 EX
5/7/85 XP 4,515,839

United States Patent [19]

Broaddus et al.

[11] Patent Number: 4,515,839

[45] Date of Patent: May 7, 1985

[54] PERMEABLE ASPHALTIC CONCRETE BASE FOR ARTIFICIAL TURF

[75] Inventors: Wayne R. Broaddus; Khalil N. Jaber; Thomas A. Orofino, all of Whitfield County, Ga.

[73] Assignee: Monsanto Company, St. Louis, Mo.

[21] Appl. No.: 546,801

[22] Filed: Oct. 31, 1983

[51] Int. Cl.[3] ..... B32B 3/02; B32B 33/00

[52] U.S. Cl. ..... 428/17; 106/98; 428/85; 428/95

[58] Field of Search ..... 428/17, 85, 95; 106/98

[56] References Cited

U.S. PATENT DOCUMENTS

| | | | |
|---|---|---|---|
| 1,763,782 | 6/1930 | Henderson et al. . | |
| 1,906,494 | 5/1933 | Steward . | |
| 2,515,847 | 7/1950 | Winkler | 154/49 |
| 2,837,984 | 6/1958 | Klotz | 94/7 |
| 3,611,729 | 10/1971 | Stark | 61/10 |
| 3,625,011 | 12/1971 | Stevenson | 61/11 |
| 3,690,227 | 9/1972 | Welty | 94/33 |
| 3,740,303 | 6/1973 | Anderson et al. | 161/67 |
| 4,007,307 | 2/1977 | Friedrich | 428/17 |
| 4,333,765 | 6/1982 | Shaw | 106/98 |
| 4,376,595 | 3/1982 | Shaw | 404/17 |

FOREIGN PATENT DOCUMENTS

| | | | |
|---|---|---|---|
| 886152 | 11/1971 | Canada | 273/27 |

OTHER PUBLICATIONS

Technical Bulletin, Astroturf TM products by Monsanto, 11-1982.

Chapter III, "Marshall Method of Mix Design", from Mix Design Methods for Asphalt Concrete (MS-2), 4th ed. (1974) by the Asphalt Inst.

ASTM D1559-76, Standard Test Method for Resistance to Plastic Flow of Bituminous Mixtures Using Marshall Apparatus.

Lovering, W. R.: "Open Graded Mix", presented at Northwest Roads & Streets Conference, University of Washington, Seattle, Washington (1963).

Case History, "Porous Park and Ride Lot", State of New York Department of Transportation, PIN 0227.80 (Jul., 1982).

Dodge, K. S.: "Open Friction Courses on an Asphalt Concrete Base", New York State Department of Transportation Res. Rep. 98 (1982). NB: p. 6.

Dodge, K. S.: "Open Friction Courses on a Portland Cement Concrete Base", New York State Department of Transportation Res. Rep. 97 (1982). NB: p. 6.

"Open-Graded Mixes Provide Drainage and Crack Relief", RETS Digest, Summer 1981, pp. 3-4.

Press Release, "Porous Asphalt Parking Lot Wins Environmental Award", Barrett, Daffin and Carlin, Inc. (1982).

New York State Department of Transportation Engineering Instruction, "Guidelines for Use of Item 15403.15 Open Graded Asphalt Surface Course" (1976).

State of California, Department of Transportation Standard Specifications, pp. 39-3, 39-4.

State of Georgia, Department of Transportation Supplemental Specifications, §828.01, "Open Graded Surface Mixtures"; §828.05, Open Graded Drainage Mixtures.

State of New Jersey, Department of Transportation, Supplementary Specifications for Open Graded Friction Course, §10A.

Miller, R. W., et al.: "Performance of Open-Graded Friction Courses", New York State Department of Transportation Res. Rep. 58 (1978). NB: pp. 2 and 6.

*Primary Examiner*—Marion E. McCamish

*Attorney, Agent, or Firm*—Thomas E. Kelley; Arthur E. Hoffman

[57] ABSTRACT

A permeable asphaltic concrete composition comprising a gradated mixture of aggregate rock which is skip-gradated. A 25 millimeter thick layer of the asphaltic concrete composition has a permeability to accommodate at least 40 centimeters per hour of rainfall. Such asphaltic concrete compositions are useful as a base for vertically-draining artificial turf systems.

10 Claims, 1 Drawing Figure

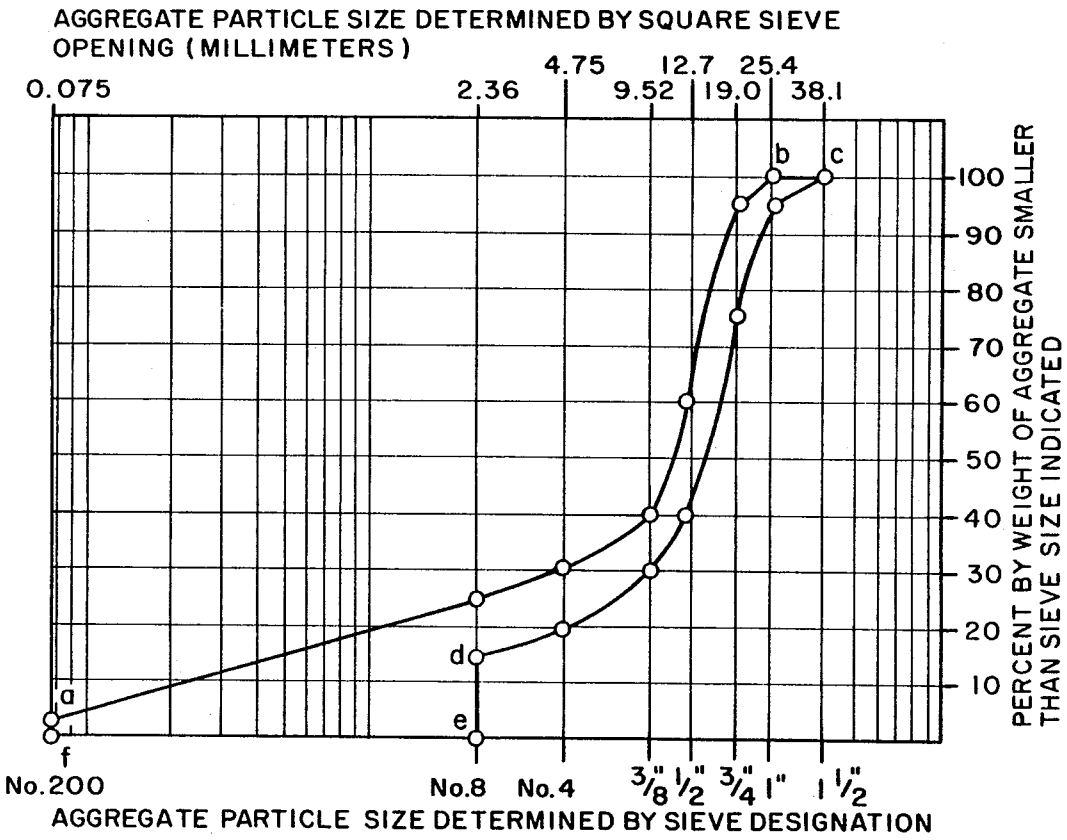
AGGREGATE PARTICLE SIZE DETERMINED BY SQUARE SIEVE OPENING (MILLIMETERS)
0.075
2.36
4.75
9.52
12.7
19.0
25.4
38.1
PERCENT BY WEIGHT OF AGGREGATE SMALLER THAN SIEVE SIZE INDICATED
100
90
80
70
60
50
40
30
20
10
a
b
c
d
e
f
No.200
No.8
No.4
3/8"
1/2"
3/4"
1"
1 1/2"
AGGREGATE PARTICLE SIZE DETERMINED BY SIEVE DESIGNATION

PERMEABLE ASPHALTIC CONCRETE BASE FOR ARTIFICIAL TURF

This invention pertains to permeable asphaltic concrete which is capable of allowing vertical drainage of substantial quantities of rainfall. This invention also pertains to the use of such permeable asphaltic concrete as an exceptionally stable support for vertically-draining artificial turf systems.

A variety of designs for playing fields have been proposed to extend recreation time into periods of rain and to provide a quality playing surface after periods of rain. Among basic field designs are the sloped playing field to allow rain water to run off and the permeable playing field to allow rain water to drain through.

Sloped playing fields may be provided with interceptors as disclosed in U.S. Pat. No. 3,611,729 which discloses vertical slots extending through the top layer of a natural field and U.S. Pat. No. 3,625,011 which discloses covered trenches for installation in an artificial turf field. In many cases fields of artificial turf comprise an impervious layer requiring slopes, for instance of a 1–1½ percent grade on American football fields, to provide water run off. In other cases where a flat field is required, for instance in baseball outfields, water is removed mechanically by blowers or vacuum cleaners.

To assist in water removal from flat playing surfaces permeable fields have been proposed in a wide variety of constructions. U.S. Pat. No. 2,837,984 discloses a quick drying tennis court comprising layers of granular limestone over a clay base. U.S. Pat. No. 1,763,782 discloses a playing field of fibrous mats inserted in a drained cement basin. U.S. Pat. No. 1,906,494 discloses a playing surface comprising a layer of felt, a layer of pervious concrete and a bedding of coarse stone or broken stone.

Grass-like artificial turf systems have been proposed as an alternaive to high maintenance surfaces such as golf putting greens which, although not necessarily flat, have been required to be highly permeable. See, for instance, U.S. Pat. Nos. 2,515,847; 3,740,303; and 4,007,307; and Canadian Pat. No. 886,152 which disclose artificial turf over permeable layers of sand, gravel, stone, rubber, plastic chips and the like. While such playing fields appear to provide some degree of permeability they do not appear to have a base with sufficient stability to maintain a smooth playing surface even with only occasional traffic of maintenance vehicles.

In recent years flat playing fields have been designed with both advantageous permeability and a strong, stable base by overlying artificial turf on a base of permeable concrete. Permeable concrete bases were proposed as early as 1930 in U.S. Pat. No. 1,906,494 which relates to playing surfaces comprising a layer of felt, a layer of pervious concrete and a bedding of coarse stone or broken stone. In one embodiment the porous concrete is said to be compounded of a mixture containing about eight parts by volume of coarse crushed stone having a mean diameter of three-quarters of an inch (about 19 millimeters) and a shape factor of about 1.5, one part by volume of Portland cement and water. Permeable concrete which may be usefuly for supporting artificial turf is also disclosed in U.S. Pat. Nos. 4,333,765 and 4,376,595.

Peremable asphaltic concrete has been utilized in the construction of special air strips, parking lots, road surfaces and other areas where vertical draining for removal of rain water to prevent ice formation and to prevent hydroplaning of vehicle tires was desired. Critical to the performance of permeable asphaltic concrete is the requirement for an open-graded aggregate mix to provide void space to facilitate vertical drainage of water. Other critical factors include resistance to stripping of asphaltic cement from the aggregate, and temperature control of the mix to prevent the asphaltic mix from flowing down off of the aggregate.

At least three automobile parking lots have been constructed from permeable asphaltic concrete at the University of Delaware during the period 1972 through 1974. As of 1983 these parking lots appear to be in excellent condition with the permeable asphaltic concrete exhibiting acceptable load-bearing properties. A parking lot has also been installed in 1981 in Tallahassee, Fla. utilizing a 4 inch (10 centimeter) layer of permeable asphaltic concrete over a 36 inch (about 90 centimeters) deep rock base.

Permeable asphaltic concrete has been applied with some success to highways to provide a friction course to minimize the possibility of hydroplaning on accumulated rain water. See, for instance, U.S. Pat. No. 3,690,227 which discloses a frictional, self-draining paving surface useful for runways and roadways comprising a porous layer of aggregate particles of greater size than 1/16 inch (about 1.6 millimeters) mesh bonded with a resinous binder.

Permeable asphaltic concrete has also been utilized as a base layer for highways. Within the last several years a 56-mile (about 90 kilometers) section of highway was constructed near Sao Paulo, Brazil where permeable asphaltic concrete was covered with a dense graded impervious asphalt. The permeable asphaltic concrete was used to carry away surface water which might otherwise have undermined the road base.

Permeable asphaltic concrete has also been utilized in the construction of athletic fields of artificial turf. Within the last five years at least 16 athletic fields have been installed in Europe and Australia with artifical turf overlaid on a base of permeable asphaltic concrete. Athletic fields in Europe comprising artifical turf installed over permeable asphaltic concrete often comply with Deutsche Normen (DIN) 18 305, Part 6 on Permeable Asphalt, April 1978, which specifies that the permeable concrete is installed in two lifts (a lift being a separate layer of concrete). The aggregate for the separate upper and lower lifts is specified according to gradation diagrams from which the gradation data listed in Table 1 has been extracted.

TABLE 1

Aggregate Gradation For Two Lifts of Permeable Concrete Extracted From Gradation Diagrams in Deutsche Normen (DIN) 18 035 (April, 1978)

| Aggregate Sieve Size (Millimeters) | Weight Percent of Aggregate Passing The Sieve | |
|---|---|---|
| | Lower Lift | Upper Lift |
| 13 | 90–100 | |
| 11 | 44–100 | |
| 9.5 | 35–75 | |
| 8 | 30–62 | 90–100 |
| 5 | 21–41 | 41–100 |
| 4 | | 30–80 |
| 3 | | 20–55 |
| 2 | 10–25 | 15–30 |
| 1.2 | 6–19 | 9–22 |
| 0.25 | 5–14 | 5–16 |

TABLE 1-continued

| Aggregate Gradation For Two Lifts of Permeable Concrete Extracted From Gradation Diagrams in Deutsche Normen (DIN) 18 035 (April, 1978) | | |
|---|---|---|
| Aggregate Sieve Size (Millimeters) | Weight Percent of Aggregate Passing The Sieve | |
| | Lower Lift | Upper Lift |
| 0.09 | 3–6 | 4–7 |

A disadvantage of such specification for permeable asphaltic concrete is of course that the asphaltic concrete be applied in two lifts, that is two separate layers. A more significant disadvantage is that the upper lift comprises aggregate of a substantially smaller particle size than an aggregate of a lower lift.

A preferred method of installing artificial turf is to glue the artificial turf assembly to the upper layer of asphaltic concrete to avoid migration of line markers on a playing field. However, in installations according to the DIN specification it is almost always required that the artificial turf be laid loosely on top of the upper lift of permeable asphaltic concrete. Gluing of turf to the upper layer of asphaltic concrete is generally precluded because the adhesive tends to occlude the smaller-size pores in the upper surface of such asphaltic concrete which comprises aggregate of smaller particle sizes.

This same deficiency is inherent in most specifications for permeable asphaltic concrete. For instance permeable asphaltic concrete designed for use in paving surfaces such as parking lots and highways generally comprise an aggregate of a small particle size to provide the necessary strength to support vehicle traffic. This requirement to provide structural strength requires significant sacrifice in the permeability qualities of the permeable asphaltic concrete.

By this invention applicants have provided a permeable asphaltic concrete with exceptional water-permeation characteristics much higher than the permeability of permeable asphaltic concretes previously known and used in paving or artificial turf installations. This has been achieved with some reduction in structural strength of the asphaltic concrete. However the highly-permeable asphaltic concrete retains a surprisingly high level of structural strength such that it can more than adequately support maintenance vehicles which may be required to traverse athletic fields without adversely the affecting desireable smooth surface and structural integrity of an athletic field covered with artificial turf.

SUMMARY OF THE INVENTION

This invention provides an asphaltic concrete composition having a permeability sufficient to accommodate an exceptionally high level of rainfall and comprises asphaltic cement and anti-stripping agent and a gradated mixture of aggregate rock of particle sizes much larger than those previously used in asphaltic concrete designs.

BRIEF DESCRIPTION OF THE DRAWING

The Drawing is a gradation diagram which illustrates the particle size ranges for the gradated mixture of aggregate rock used in the asphaltic concrete composition of this invention.

DESCRIPTION OF PREFERRED EMBODIMENTS

By this invention applicants have provided an asphaltic concrete composition which is particularly useful as a base to support artificial turf. Such asphaltic concrete compositions have a permeability sufficient to accommodate at least 40 centimeters per hour of rainfall at 25 millimeters of thickness of concrete. Desirably the asphaltic concrete composition can exhibit higher permeability, for instance at a depth of 7.6 centimeters such concrete can accommodate at least about 100 centimeters per hour of rainfall, or more, say about 150 centimeters per hour of rainfall, and in some cases it has been shown to be able to accommodate about 213 centimeters per hour of rainfall.

The permeable asphaltic concrete composition of this invention comprises asphaltic cement, an anti-stripping agent and a gradated mixture of aggregate rock of a specific size gradation containing aggretate of much larger particle sizes than has been generally previously utilized.

The asphaltic concrete composition of this invention comprises a gradated mixture of aggregate rock having a size gradation such that the percentage by weight of the mixture passing through a sieve having square openings is within the limits expressed in Table 2.

TABLE 2

| Aggregate Gradation For Permeable Asphaltic Concrete According To This Invention | | | |
|---|---|---|---|
| Aggregate Sieve Designation | Square Sieve Opening (Millimeters) | Square Sieve Opening (Inches) | Weight Percent of Aggregate Passing the Sieve |
| 1½ | 38.1 | 1.5 | 100 |
| 1 | 25.4 | 1.0 | 95–100 |
| ¾ | 19.0 | 0.75 | 75–95 |
| ½ | 12.7 | 0.5 | 40–60 |
| ⅜ | 9.52 | 0.375 | 30–40 |
| No. 4 | 4.75 | 0.187 | 20–30 |
| No. 8 | 2.36 | 0.094 | 15–25 |
| No. 200 | 0.075 | 0.003 | 0–3 |

The gradation of the aggregate rock can also be determined by reference to The Drawing which graphically illustrates the gradation specified in Table 2. The Drawing provides a gradation diagram which is a semi-logarithmic plot of the percent by weight of aggregate smaller than the size indicated (that is, the percent by weight passing a designated sieve) versus the particle size of the aggregate rock as determined by sieve designation. With reference to The Drawing the gradated mixture of aggregate rock useful in the permeable asphaltic concrete of this invention is required to have a size distribution substantially within the area identified as a-b-c-d-e-f-a.

This gradated mixture comprises a very high percent by weight of aggregate rock above the ⅜ sieve size. About 60 to 70 percent by weight of the aggregate rock is above the ⅜ sieve size. A minor amount by weight, for instance in the range of about 15 percent by weight, of the aggregate rock is in the range of No. 8 to ⅜ sieve size. A somewhat larger but still minor amount by weight of the aggregate rock is in the range of No. 200 to No. 8 sieve size. Essentially none of the aggregate rock is of a size smaller than No. 200 sieve size. Because of the specification the gradation profile is bimodal with points of inflection near the ends of the particle size distribution bracket by the No. 8 and the ⅜ sieve size. Such a gradation profile is referred to as "skip-graded" or "gap-graded". In this regard the large percentage of aggregate rock above ⅜ sieve size provides exceptional porosity, enhanced permeability, to the asphaltic concrete. The minor amount by weight of aggregate rock in the No. 8 to ⅜ sieve bracket provides considerable stability to the aggregate within the concrete without unduly impairing permeability.

The shape of the aggregate rock is also critical in the permeable asphaltic concrete of this invention. The three dimensions of the individual particles of the aggregate rock should be of the same order of magnitude. Such particles are described as being bulky in shape. Many of these bulky particles of aggregate rock are approximately spherical. in this regard it is undesireable that anything but a minor amount by weight of the aggregate rock be of plate-like shape or rod-like shape.

The aggregate rock may comprise any of a variety of compositions, for instance crushed quarry stone of granite or washed gravel or any other stable mineral composition which can be graded to the required specifications.

In preparing the permeable asphaltic concrete of this invention it is desireable that the aggregate rock be substantially free of moisture to promote the adhesion of the asphaltic cement to the aggregate. In this regard it is desireable that an anti-stripping agent be added to the dry mix of the aggregate rock prior to the introduction of asphaltic cement. Such anti-stripping agents are intended to remove residual moisture provide better contact and promote adhesion between the asphaltic cement and the aggregate rock. A useful anti-stripping agent comprises hydrated lime which can be added at a rate of about 1 percent by weight based on the dry weight of the aggregate rock. The anti-stripping agent such as hydrated lime should be adequately mixed with the aggregate rock to sufficiently coat the dry aggregate rock at a point in the mixing process so as not to become unduly air entrained in the exhaust air system of the mixing plant.

Alternatively, promotion of adhesion of asphaltic cement to aggregate is sometimes achieved by adding surface active agents to asphaltic cement. Preferred surface active agents include those derived from lignin. Such surface active agents should be used in minor amounts, say at a level of about 0.5 percent by weight of the liquid asphaltic cement. At high levels of surface active agent the viscosity of the asphaltic cement can be significantly reduced which may promote separation of the cement from the aggregate and puddling of cement at the bottom of the layer of concrete. Moreover at high levels of surface active agent the concrete may tend to be susceptible to stripping by water.

The permeable asphaltic concrete of this invention also comprises an asphaltic cement which is present at a level of about 4.5 percent by weight of the asphaltic concrete. Suitable asphaltic concretes include those designated as AC-5, AC-10, AC-20 or AC-30, or their equivalents, the selection of which depends on geographical considerations, such as weather and climate, and material availability.

The Mix Design Methods For Asphalt Concrete published by the Asphalt Institute as Manual Series No. 2 (MS-2), Fourth Edition, March 1974, is particularly useful in defining terms and methods relating to this invention, especially in Chapter III, incorporated herein by reference, which relates to the Marshall Method of Mix Design.

The Marshall Method of Mix Design provides procedures useful in specifying certain parameters for preparing the hot mix of the asphaltic concrete of this invention. Among the more critical criteria of the Marshall Method are what is known as "flow", "stability" and "voids". The Marshall Method of Mix Design test procedures have been standarized by the American Society for Testing and Materials (ASTM) as Test Method D-1559, entitled a Standard Test Method for "RESISTANCE TO PLASTIC FLOW OF BITUMINOUS MIXTURES USING MARSHALL APPARATUS", incorporated herein by reference.

The Marshall Method of Mix Design is generally applicable only to hot-mix asphalt paving mixtures containing aggregates with maximum sizes of 1 inch (25.4 millimeters) or less. However, for purposes of defining and practicing this invention the Marshall Method of Mix Design will be modified where necessary. For instance, the method will be extended to apply to mixtures containing aggregate with maximum size of 1½ inch (38 millimeters).

This Marshall Method of Mix Design is generally modified in conducting stability and flow tests of permeable asphaltic concrete such that these tests are conducted at room temperature, that is, at 25° C., rather than at the generally specified test temperature of 140° F. (60° C.). This is necessary because permeable asphaltic concretes are generally intrinsically extremely weak and often degrade at the generally specified test temperature of 140° F. (60° C.). At best previously known permeable asphaltic concrete compositions have disintegrated at loads of about 200 $lb_f$ (890 newtons) when tested at 140° F. (60° C.).

Surprisingly the permeable asphaltic concrete of this invention is remarkably stable at the specified test temperature of 140° F. (60° C.) and have exhibited "stability" at loads in the range of 700 to 900 $lb_f$ (3100 to 4000 newtons). In this regard the permeable asphaltic concrete compositions of this invention will preferably exhibit stability of at least about 400 $lb_f$ (1780 newtons) and more preferably at least about 500 $lb_f$ (2225 newtons) at the specified test temperature of 140° F. (60° C.).

In this regard the constituents of the permeable asphaltic concrete should be proportioned to produce permeable asphaltic concrete having a "Marshall" flow at 25° C. in the range of about 8 to $20\times10^{-2}$ inches (2 to 5 millimeters), "Marshall" a stability at 60° C. of at least 400 $lb^f$ (2780 newtons). Moreover it is generally desireable that the permeable asphaltic concrete be compacted to have voids at a level of at least 10 percent by volume and preferably in the range of 12 to 22 percent by volume.

In preparing the hot mix of the permeable asphaltic concrete of this invention care should also be taken to control the temperature of the asphaltic concrete hot mix so as to minimize asphaltic concrete separation from the aggregate rock. When using asphaltic cement having a viscosity designation AC-10 satisfactory results have been obtained by maintaining hot mix in the temperature range of from 116° C. to 127° C.

The permeable asphaltic concrete of this invention is particularly useful as a base for supporting artificial turf. In constructing an artificial turf playing field using the permeable base of this invention, the area under the intended playing field is generally excavated to a suitable depth. The earth remaining after excavation should be compacted to avoid any potential for settling which might disrupt the plane of the playing surface.

A conduit system is often placed in the bottom of the excavation to facilitate water removal. It is often desirable to locate the conduit system in narrow trenches to minimize excavation costs. Such a conduit system can comprise perforated pipe connected to headers of standard pipe. Trenches can be back-filled with coarse stone.

It is advantageous to line the surface of the excavation with an engineering filter fabric which assists in distributing loads, promotes lateral drainage and prevents fouling of the permeable base by migrating fines which might be carried by ground water.

The permeable base is installed in the excavated area over such optional engineering filter fabric. One useful engineering filter fabric has the following specifications:

1. Puncture Resistance as measured by Mullen Burst Strength (ASTM D-3786) in the range of 190 to 650 psig (13 to 46 $Kg/cm^2$);

2. Trapezoid Tear Strength (ASTM 1117) in the range of 30 to 140 $lb_f$ (130 to 620 newtons);

3. Grab Tensile Strength (ASTM D-1682) in the range of 90 to 375 $lb_f$ (400 to 1670 newtons); and 4. Thickness in the range of 40 to 150 millimeters.

A layer of permeable aggregate is generally placed in the excavated area to provide a subbase, followed by at least one layer of asphaltic concrete to provide a permeable base. The base is overlaid with an artificial turf which may optionally comprise a layer of resilient polymeric foam cushion. It is generally desirable that the artificial turf be glued to the optional cushion layer and that the artificial turf or cushion layer be glued to the base. For instance a suitable adhesive is used to glue the artificial turf to the underlying layer of resilient polymeric foam cushion. Similarly, the artificial turf is desirably glued to the permeable asphaltic concrete base. Sufficient adhesive is required to provide a good bond between the layers. However, the adhesive should not be applied in such excessive amounts as to occlude pores in the top surface of the permeable asphaltic concrete. In this regard the permeable asphaltic concrete of this invention is advantageous in that it utilizes aggregate rock of a sufficiently large size that the possibility of pore occlusion by the adhesive is minimized.

In order to provide an athletic field comprising artificial turf which is vertically-draining to remove rain water it is necessary that the layer or layers of artificial turf be permeable. Artificial turf can generally be provided in a permeable configuration. For instance, artificial turf of knitted or woven construction is generally permeable. Artificial turf or tufted construction is generally not permeable unless holes or perforations are provided after the turf is fabricated. The optional resilient polymeric foam cushion can be made permeable by either utilizing an open-celled polymeric foam or, when a close-celled polymeric foam is utilized a cushion can be made permeable by punching or drilling a sufficient number of holes in the polymeric foam cushion. Sufficient holes should be provided so as to provide suitable permeability without adversely affecting the resilient properties of the cushion.

While specific embodiments of the invention have been described, it should be apparent to those skilled in the art that various modifications thereof may be made without departing from the true spirit and scope of the invention. Accordingly it is intended that the scope of the following claims cover all such modifications which fall within the full inventive concept.

We claim:

1. An aphaltic concrete composition having a permeability sufficient to accommodate at least 40 centimeters per hour of rainfall at 25 mm of thickness of concrete comprising asphaltic cement, anti-stripping agent, and a gradated mixture of bulky aggregate rock having a size gradation such that the percentage by weight of the mixture passing through a sieve having square openings of (a) 38.1 millimeters is 100 percent,
(b) 25.4 millimeters is 95–100 percent,
(c) 19.0 millimeters is 75–90 percent,
(d) 12.7 millimeters is 40–60 percent,
(e) 9.52 millimeters is 30–40 percent,
(f) 4.75 millimeters is 20–30 percent,
(g) 2.36 millimeters is 15–25 percent, and
(h) 0.075 millimeters is 0–3 percent.

2. The composition of claim 1 comprising about 4.5 percent by weight of asphaltic cement.

3. The composition of claim 2 wherein the anti-stripping agent comprises hydrated lime at a level of 1 percent by weight based on the weight of the gradated mixture of aggregate solids.

4. An asphaltic concrete composition having a permeability sufficient to accommodate at least 40 centimeters per hour of rainfall at 25 mm of thickness of concrete comprising asphaltic cement, anti-stripping agent, and a gradated mixture of bulky aggregate rock having a size gradation such that the percentage by weight of the mixture passing through a sieve having square openings of (a) 38.1 millimeters is 100 percent,
(b) 25.4 millimeters is 95–100 percent,
(c) 19.0 millimeters is 75–95 percent,
(d) 12.7 millimeters is 40–60 percent,
(e) 9.52 millimeters is 30–40 percent,
(f) 4.75 millimeters is 20–30 percent,
(g) 2.36 millimeters is 15–25 percent, and
(h) 0.075 millimeters is 0–3 percent; wherein said composition exhibits stability as measured by the Marshall Method of Mix Design at 140° F. of at least 500 $lb_f$.

5. A playing field comprising a layer of permeable artificial turf and a base comprising an asphaltic concrete composition having a permeability sufficient to accommodate at least 40 centimeters per hour of rainfall at 25 mm of thickness of concrete comprising asphaltic cement, anti-stripping agent, and a gradated mixture of bulky aggregate rock having a size gradation such that the percentage by weight of the mixture passing through a sieve having square openings of (a) 38.1 millimeters is 100 percent,
(b) 25.4 millimeters is 95–100 percent,
(c) 19.0 millimeters is 75–95 percent,
(d) 12.7 millimeters is 40–60 percent,
(e) 9.52 millimeters is 30–40 percent,
(f) 4.75 millimeters is 20–30 percent,
(g) 2.36 millimeters is 15–25 percent, and
(h) 0.075 millimeters is 0–3 percent.

6. The composition of claim 5 comprising about 4.5 percent by weight of asphaltic cement.

7. The composition of claim 6 wherein the anti-stripping agent comprises hydrated lime at a level of 1 percent by weight based on the weight of the gradated mixture of aggregate solids.

8. A playing field comprising a layer of permeable artificial turf, a layer of permeable polymeric foam cushion, and a base comprising an asphaltic concrete composition having a permeability sufficient to accommodate at least 40 centimeters per hour of rainfall at 25 mm of thickness of concrete comprising asphaltic cement, anti-stripping agent, and a gradated mixture of bulky aggregate rock having a size gradation such that the percentage by weight of the mixture passing through a sieve having square openings of (a) 38.1 millimeters is 100 percent,
(b) 25.4 millimeters is 95–100 percent,
(c) 19.0 millimeters is 75–95 percent,
(d) 12.7 millimeters is 40–60 percent,
(e) 9.52 millimeters is 30–40 percent,
(f) 4.75 millimeters is 20–30 percent,
(g) 2.36 millimeters is 15–25 percent, and
(h) 0.075 millimeters is 0–3 percent.

9. The composition of claim 8 comprising about 4.5 percent by weight of asphaltic cement.

10. The composition of claim 9 wherein the anti-stripping agent comprises hydrated lime at a level of 1 percent by weight based on the weight of the gradated mixture of aggregate solids.

* * * * *